US007781752B2

(12) United States Patent
Chiocca

(10) Patent No.: US 7,781,752 B2
(45) Date of Patent: Aug. 24, 2010

(54) DEVICE AND METHOD FOR CONDITIONING NUCLEAR FUEL ASSEMBLIES WITH DOUBLE CONFINEMENT BARRIER

(75) Inventor: René Chiocca, Paris (FR)

(73) Assignee: Cogema Logistics, Le Bretonneux (FR)

( * ) Notice: Subject to any disclaimer, the term of this patent is extended or adjusted under 35 U.S.C. 154(b) by 646 days.

(21) Appl. No.: 10/578,147

(22) PCT Filed: Oct. 28, 2004

(86) PCT No.: PCT/FR2004/050548

§ 371 (c)(1),
(2), (4) Date: Mar. 23, 2007

(87) PCT Pub. No.: WO2005/045849

PCT Pub. Date: May 19, 2005

(65) Prior Publication Data

US 2007/0274430 A1 Nov. 29, 2007

(30) Foreign Application Priority Data

Nov. 3, 2003 (FR) ..... 03 50775

(51) Int. Cl.
*G21F 5/00* (2006.01)

(52) U.S. Cl. ..... 250/515.1; 250/505.1; 250/506.1; 250/507.1; 376/287

(58) Field of Classification Search ..... 250/505.1, 250/506.1, 507.1, 515.1; 376/1
See application file for complete search history.

(56) References Cited

U.S. PATENT DOCUMENTS

| | | | | |
|---|---|---|---|---|
| 4,422,964 | A | 12/1983 | Capolupo | 252/628 |
| 4,626,380 | A | 12/1986 | Baatz et al. | 250/506.1 |
| 4,780,269 | A | 10/1988 | Fischer et al. | 376/272 |
| 4,836,975 | A * | 6/1989 | Guldner et al. | 376/272 |
| 4,983,282 | A | 1/1991 | Roy et al. | 210/95 |
| 2003/0010938 | A1 | 1/2003 | Michels et al. | 250/507.1 |

FOREIGN PATENT DOCUMENTS

| | | |
|---|---|---|
| JP | 08220294 | 8/1996 |
| JP | 09080196 | 3/1997 |

OTHER PUBLICATIONS

Search Report (French Preliminary) FR 0350775 (Nov. 3, 2003).
Search Report (International Preliminary) PCT/FR 2004/050548 (Oct. 28, 2004).

* cited by examiner

*Primary Examiner*—Jack I Berman
*Assistant Examiner*—Hanway Chang
(74) *Attorney, Agent, or Firm*—Nixon Peabody LLP

(57) ABSTRACT

Transport and storage of nuclear fuel assemblies may require double confinement depending on the circumstances. A device and a method are described to perform this double conditioning without the need of a hot containment, and in which the loading and pre-positioning steps can take place in a pool.

The device (10) includes a metallic inner leak tight conditioning receptacle (20) and a metallic outer leak tight receptacle (30). When the inner receptacle (20) is located in the outer receptacle (30), a passage (15, 25) remains free between the two receptacles, from the open end to the bottom of the outer receptacle. The outer receptacle (30) can be drained through this passage, particularly by a dip tube (33).

24 Claims, 6 Drawing Sheets

DEVICE AND METHOD FOR CONDITIONING NUCLEAR FUEL ASSEMBLIES WITH DOUBLE CONFINEMENT BARRIER

CROSS-REFERENCE TO RELATED APPLICATION

This application claims priority based on International Patent Application No. PCT/FR2004/050548, entitled "Device and Method For Conditioning Nuclear Fuel Assemblies With Double Confinement Barrier" by inventor Rene Chiocco, which claims priority of French Application No. 03 50775, filed on Nov. 3, 2003, and which was not published in English.

TECHNICAL FIELD

This invention relates to conditioning of nuclear fuel assemblies and more particularly to devices enabling double confinement of assemblies, and the conditioning procedure in receptacles before transport or storage, if any.

BACKGROUND ART

Nuclear fuel assemblies require particular procedures for their use, transport and even for disposal as waste. Thus, irradiated nuclear fuel assemblies from nuclear power stations have to be stored after use. Nuclear power plants are provided with a pool in which these assemblies are stored, but this storage is temporary and the nuclear fuel assemblies then have to be evacuated to safe so-called "final" or "interim" storage sites, and in particular including leak tight metallic confinements protected by concrete storage modules.

To transport them to their destination, leak tight confinements containing nuclear fuel assemblies need to be put into place in "temporary" radiation shielding receptacles. Therefore safety rules that impose confinement of nuclear fuel assemblies in a leak tight metallic receptacle are respected, the receptacle itself being placed in a package called the transfer package with radiation shielding walls. The metallic receptacle comprises essentially a hollow tubular body with a generally cylindrical shape with a circular cross section, equipped with a closed lower end and a completely open upper end. Document FR 2 805 655 describes an example of this technique.

One conventional possibility for positioning nuclear fuel assemblies in the metallic receptacle and in the transfer package is to use a "dry" or "hot" radiation shielding containment with remote manipulations of the different elements using manipulation arms: it is obvious that working people cannot be close to elements without any radiation shielding. The disadvantage of this method is its complexity, and consequently the time and cost, of the containment and also the tools and manipulation arms.

Since water is good radiation shielding and all power plants have a pool, it has been proposed to package the radiation material directly in pools. In this context, the metallic confinement receptacle is placed in the transfer package, the assembly is immersed in the pool and fuel is loaded into it. The loading opening is then closed off by a radiation shielding closing device that provides protection during the following steps consisting of closure, confinement and transport that take place dry: for example see FR 2 805 655. However, this technique is more restrictive because part of it has to be done while totally immersed in more than ten meters of water. Furthermore, to achieve maximum safety, it is essential to eliminate all residual water in receptacles before closing them, both in the metallic confinement receptacle and in the transfer package.

However it is possible that an additional confinement, subsequently called the "second confinement" is necessary in addition to the confinement provided by the leak tight metallic receptacle: a second additional containment needs to be put into place. Some legislation imposes this second double containment. In this case, conditioning under water has not been possible up to now, particularly due to problems with drainage of the second confinement containment.

SUMMARY OF THE INVENTION

The invention proposes to solve problems inherent to drainage of double receptacles.

According to one of its aspects, the invention relates to a double receptacles device with a geometry designed to enable drainage and adding of inert gas into the outer receptacle, or checking the seal. Due to the presence of a free passage between the two receptacles, which are also adjusted one in the other, the outer receptacle may be drained for example by a dip tube that descends down to the bottom of the receptacle. Another advantage of this is that all actions can take place on the same upper end of the receptacles, which is preferable for closing after partial exit from the pool, which correspondingly simplifies the tools used, increasing personnel safety.

The two receptacles can be one leak tight metallic receptacle and its radiation shielding package, but it is also possible that each receptacle is a leak tight metallic conditioning receptacle, the device itself possibly being integrated into a radiation shielding package. A double confinement under water can thus be achieved without making the conditioning system more complicated due to the presence of a dry confinement containment.

Advantageously, the inner receptacle is a leak tight metallic receptacle that includes a central duct, in other words it is annular in section. The inner duct will be used for drainage and for adding inert gas into the outer receptacle and/or for the leak tightness check. Advantageously, a closing plate system is used to make the inner receptacle leak tight before the outer receptacle is closed and drained. The same closing plate system can be used for the outer receptacle.

Another possibility, for example when the shape of the inner receptacle is fixed, is the presence of a protuberance on the outer receptacle that will delimit the passage.

The invention also relates to a double receptacle drainage process, and a process for conditioning radioactive equipment using this drainage process. These processes make it possible to package equipment under water. Advantageously, two leak tight metallic receptacles are used so as to achieve double confinement of the radioactive material without complicating the necessary equipment due to the presence of a dry containment, each step possibly being performed under water.

Another aspect of this invention is a leak tight metallic inner receptacle, the shape of which facilitates existing procedures, particularly concerning draining and therefore sealing the outer receptacle in which it will subsequently be conditioned. Consequently the inner receptacle, composed of a conventional container with a non removable bottom, is also equipped with a duct that passes through the bottom and leaves a free passage when the receptacle is sealed. This passage enables the introduction of gas and/or suction into the receptacle surrounding it.

Other advantages of the invention and some preferred variants will become clearer to those skilled in the art from the following description.

BRIEF DESCRIPTION OF THE FIGURES

The invention will be better understood after studying the appended figures, which are only given for guidance and are in no way limitative.

DETAILED DESCRIPTION OF PARTICULAR EMBODIMENTS

Figure 1:
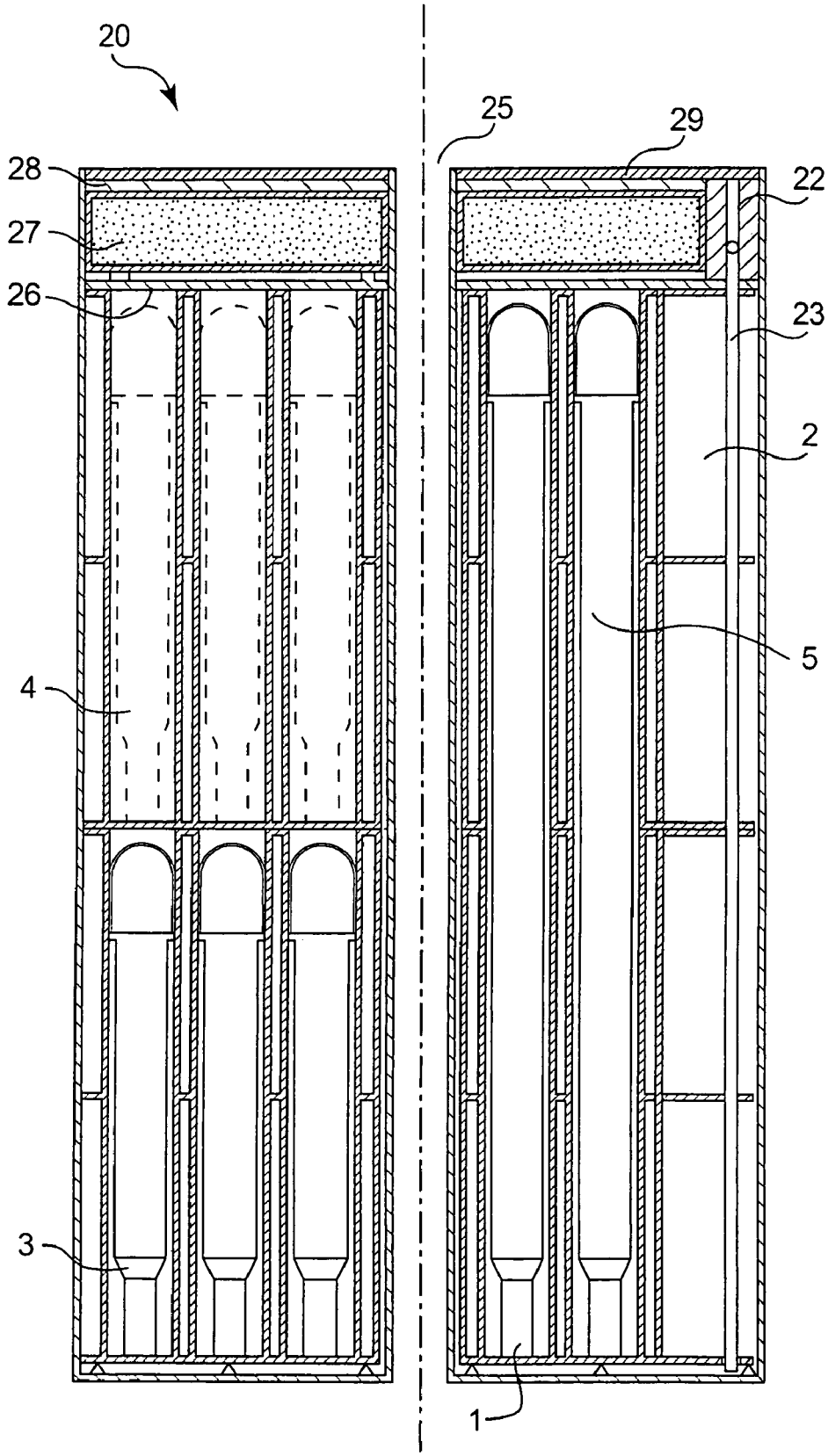
FIG. 1 shows a preferred embodiment of an inner metallic receptacle with baskets and a closing system.

FIG. 1 shows a metallic confinement receptacle (20), formed from a cylindrical receptacle with sidewalls and a loading opening, closed at its lower end by non-removable bottom. A duct (25) with a circular section also passes through the centreline of the metallic receptacle (20): therefore, the duct has walls along its length but remains open at both its ends. The walls of the receptacle, in other words the sidewalls and the walls of the duct, resist radioactivity but do not necessarily provide radiation shielding. It is obvious that these different forms and arrangements are preferred but not essential examples; for example a receptacle with a parallelepiped shaped section, a side duct and/or a duct with any other shape are other possibilities.

Before loading irradiated fuel assemblies (1), the confinement receptacle (20) is placed in the pool of the nuclear power station. In the context of safety measures and particularly processes according to the invention, the receptacle is usually added firstly into one or two other receptacles, as will be described later.

A basket (2) can be placed inside the metallic receptacle, preferably before immersion in the pool, for the nuclear fuel assemblies (1). Another possibility is the superposition of baskets. For example, within this context it is possible to put the lower basket (3) into place, fill the compartments (5) of the basket with fuel after immersion, and then repeat the operation with the upper basket (4) that has a filter base. Note that in this preferred case, the duct (25) occupies the place of one compartment (5) in the basket.

A filter plate (26) is then preferably placed above the basket(s) to retain impurities in the baskets, without them reaching the closing system.

After the metallic receptacle (20) has been loaded, in the pool in the context of the invention, water and all non-inert gases have to be evacuated from the confinement.

Figure 2:
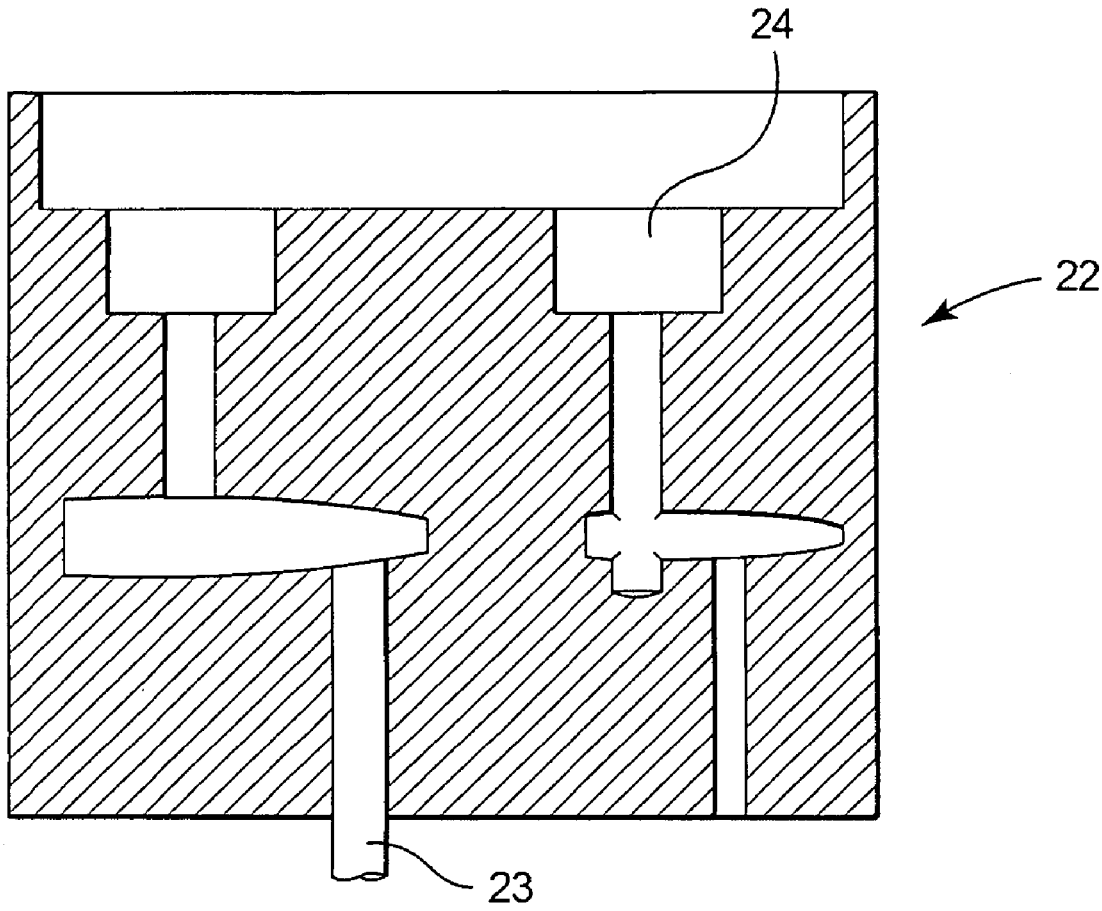
FIG. 2 shows an example of a drainage device.

One of the options selected to facilitate drainage of the metallic receptacle is to provide means of draining the receptacle; one preferred example of the drainage means is shown in FIG. 2. In fact, a drainage device (22) equipped with two self-closing orifices and a dip tube (23) is placed in the upper part of the receptacle, along the wall that does not form part of the duct; preferably, it is located above a space left free by the compartments (5) and welded to the wall. The dip tube (23) is preferably connected by welding to one of the two self-closing orifices of the device (22); the second orifice (24) opens up under the device and acts as a vent. The drainage device (22) can also be welded with its dip tube (23) before the baskets (2, 3, 4) are put into place.

A shielded plug (27) is placed above the filter plate, to provide axial radiation shielding during drainage and closing operations. However, this shielded plug leaves access to the drainage device (22) equipped with the free dip tube (23): this enables drainage and the addition of inert gas into the receptacle. Due to the plug (27), it is then possible to take the metallic receptacle (20) and the receptacle(s) surrounding it from the pool that provides radial radiation shielding.

One preferred possible method of keeping the shielded plug (27) in position is to use a primary closing plate (28). The water level is lowered in receptacle just below the level of the shielded plug (27). The primary closing plate (28) is then put into place, for example by welding, along the walls of the duct (25), of the metallic receptacle (20) and of the drainage device (22). The metallic receptacle can then be drained.

One of the methods used for drainage consists of injecting compressed air through the self-closing orifice (24), or by suction through the drainage tube (23). The metallic receptacle (20) is then drained and dried by vacuum suction; drying can be checked by a pressure rise test. Finally, an inert gas is injected ($N_2$ or preferably He). Preferably, the top end of the drainage device (22) is then closed by welding an orifice plate (28') (see FIG. 5).

A secondary annular-shaped closing plate (29) is housed inside the walls of the metallic receptacle (20) above the primary plate (28), but it also covers the drainage device (22) so as to make the metallic receptacle leak tight, for example by welding. The presence of this plate (29) also makes it possible to check the leak tightness of the assembly formed beforehand, by checking gas exchange.

Note that the fuel is then confined in the metallic receptacle (20) that forms a closed volume, except for the duct (25) that passes through the primary closing plate (28) and the secondary closing plate (29), and the bottom of the receptacle (20). The duct (25) is used for drainage of the receptacle surrounding the first metallic confinement receptacle: the duct leaves a free passage that will enable gas and liquid exchanges to take place in both ways in the receptacle (30, 40) surrounding the metallic receptacle (20).

As already mentioned, the leak tight metallic confinement receptacle (20) is usually located in a second receptacle (30). The two receptacles are adjusted: the space separating them is preferably minimum; it is also desirable to prevent movement between the two receptacles and to limit the residual gas volume between the two receptacles that is prejudicial to heat exchanges. For example, when two leak tight cylindrical metallic receptacles (20, 30) are considered, a clearance of a few millimeters (1 cm maximum) between the two receptacles with a diameter of the order of 1 m-1.5 m is usually tolerated (the normal length is 3 to 4.5 m with an approximately 80 mm diameter duct, namely the size of a fuel assembly).

However, within the framework of the invention and so that all operations can be performed under water, the second receptacle, or outer receptacle, was present in the pool for example under 10 m of water. Therefore, water remains between the two receptacles regardless of the adjustment between the two volumes, and the outer receptacle has to be drained.

Figure 3C:
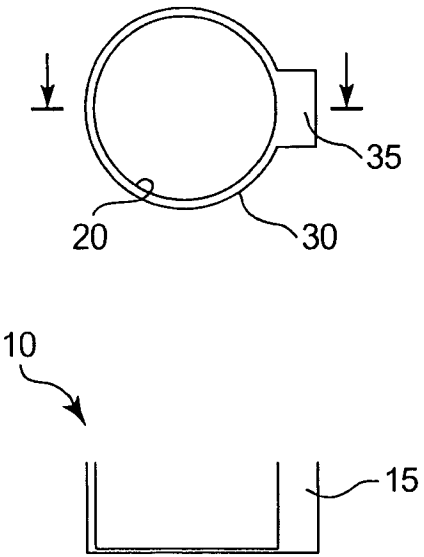
FIG. 3 diagrammatically shows possible geometries for the device according to the invention.
Figure 3B:
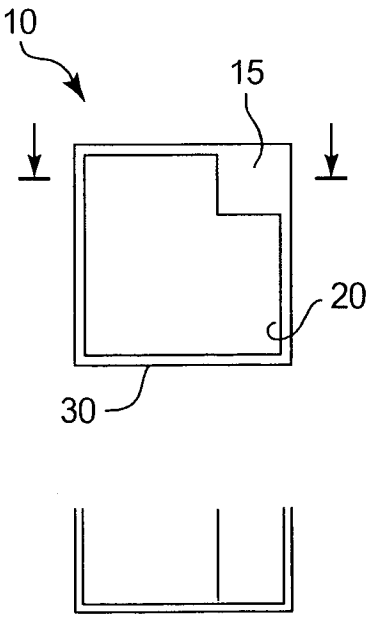
Figure 3A:
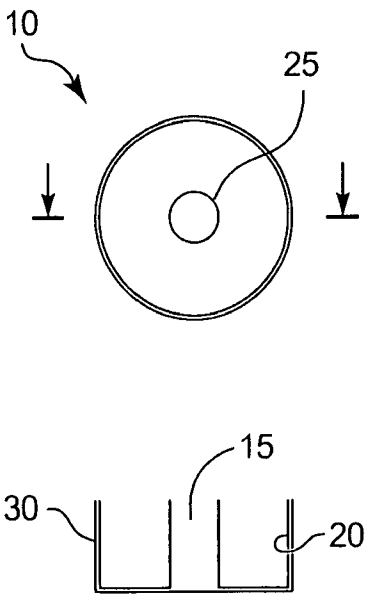

Although the duct is a preferred solution to enable drainage for a cylindrical receptacle, in fact all that is necessary is for a single passage (15) to remain free between the two receptacles (20, 30) when one is located in the other. For example, if the inner metallic conditioning receptacle does not have a duct, it is possible to adapt the geometries of the two receptacles (20, 30) so as to have a sufficiently large passage while tolerating the 1% adjustment tolerance over most of the surface. Thus, FIGS. 3*a*, 3*b* and 3*c* show different possible geometry types to achieve this result; these options also form part of the invention. FIG. 3*a* shows the embodiment with a duct according to the invention that is preferred because the symmetric receptacles are easier to manipulate during automated welding procedures. FIG. 3*c* may be recommended for example if the shape of the fuel baskets cannot be adapted to the "hole" necessary for the duct to pass through. In this case, a protuberance (35) on the outer receptacle (30) performs the same function.

Figure 4:
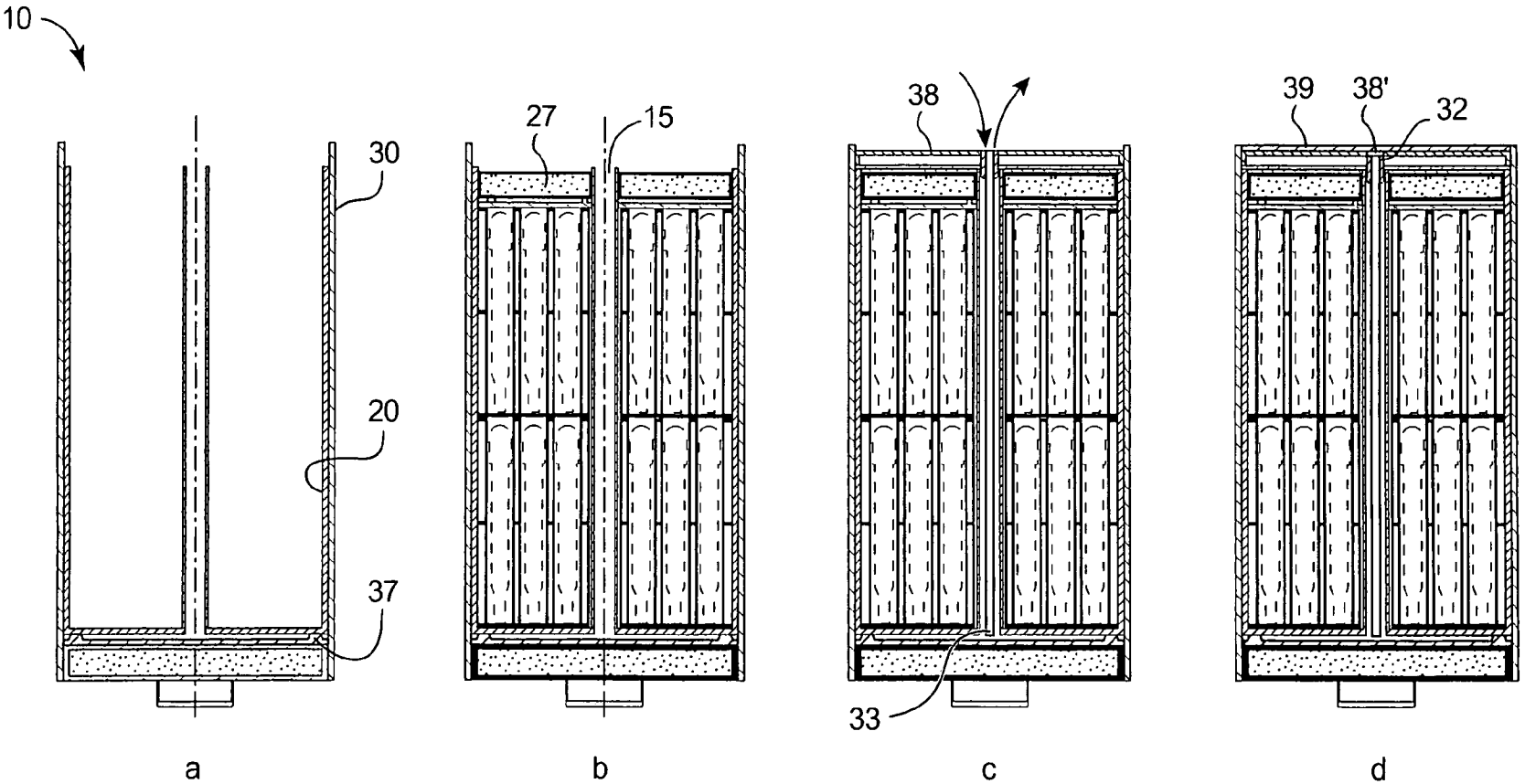
FIG. 4 diagrammatically shows a drainage procedure according to the invention.

The drainage process is then as follows: the device (10) is prepared, with placement of the inner metallic receptacle (20) in the outer receptacle (30) and immersion into the loading pool (FIG. 4*a*). To facilitate and optimise future drainage procedures, it is preferable to leave a clearance at the bottom between the two receptacles, for example through spacer pads (37). The inner metallic receptacle is filled and made leak tight, for example using the procedure described above (FIG. 4*b*).

Figure 5:
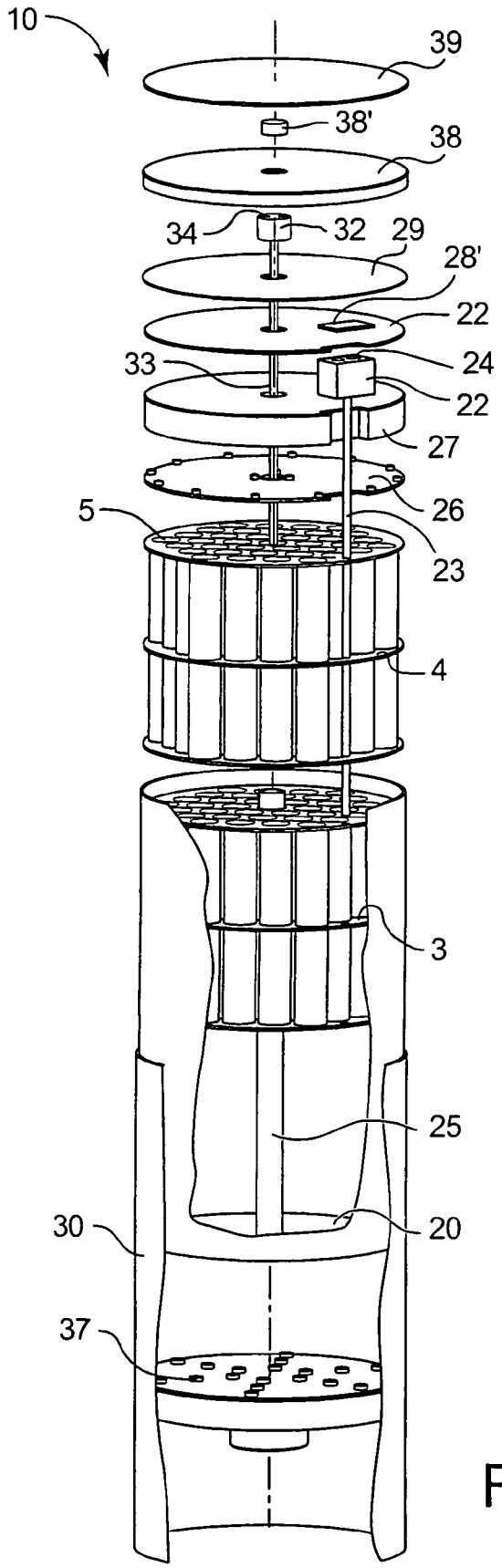
FIG. 5 shows a preferred embodiment of the main constituents of a double leak tight metallic receptacles device.

The outer receptacle is closed by means of a leak tight head (38) including a drainage device (32) welded in the central part as shown in the figure, similar to the device used to drain the inner receptacle or as shown in FIG. 2: the drainage device (32) is thus equipped with a first self-closing orifice to which a dip tube (33) is connected, and a second self-closing orifice (34) opening under the drainage device and acting as a vent (see FIG. 5). The drainage device (32) is actually located facing the passage (15) such that the dip tube (33) can penetrate into the passage. It can then be drained (FIG. 4*c*): compressed air is injected through the orifice (34) or suction takes place through the drainage tube (33) to remove residual water. Drainage and drying then take place through vacuum suction. Preferably, a check of the leak tightness of the outer receptacle can be made through the passage (15), for example by a pressure rise test. Similarly, a drying check can be made by a pressure rise test. Finally, an inert gas (He or $N_2$) is injected.

The next step is to close off the two self-closing orifices, for example by welding an orifice plate (38') above the drainage device (32) so as to achieve confinement. In the same way as for the inner metallic receptacle, the seal can be made using a second leak tight head (39) that will be welded to the outer casing (30) (FIG. 4*d*) and this leak tightness can be checked, particularly by a pressure rise in the space between the covers (38, 39).

The outer receptacle (30) may be a storage and/or transfer package (40), for which the sidewalls are then radiation shielding. This package is closed at its lower end (in the direction of FIG. 4), removably or non-removably depending on the unloading procedure used in the storage site. It is provided with a cover (38) at its other end. For example this cover may be screwed, but if long-term storage is planned, it can be welded. Usually, if screwing is used, the self-closing orifices are closed by closing off with a head and then with a plug, before final sealing.

The device drainage and method according to the invention makes the closing method simpler than existing procedures. In this case, unlike the device described in document U.S. Pat. No. 4,780,269, only the head (38) is provided with a drainage device (32) used for drainage and to add inert gases and/or for checking the leak tightness; all actions following drainage and closure are carried out at this same end of the package. Therefore, there is no need to have a second system to close a lateral orifice at the bottom of the package. Furthermore, methods using transfer packages with a single orifice used in the state of the art require complex procedures to prevent water from entering between the two receptacles and check means to assure that the leak tightness has been maintained.

Therefore, another advantage of the drainage method according to the invention is the possibility of creating a double confinement. This is done by choosing the outer receptacle as being a second metallic confinement receptacle (30). A second metallic receptacle has a non-removable bottom and will normally be made "permanently" leak tight. FIG. 5 shows that the bottom of the outer metallic receptacle can provide radiation shielding, but this is not necessary. It may include spacer pads (37).

The closing/drainage procedure of the outer metallic receptacle (30) is similar to that described above for the inner metallic receptacle (20). The radiation shielding plug is not useful in this case, since radiation shielding is provided by the plug (27) of the inner metallic receptacle (20). A second primary closing plate (38) is provided to close the second metallic receptacle (30): it is provided with a drainage device (32) at its centre provided with a dip tube (33) that penetrates into the duct (25) that remained free, for drainage and for addition of inert gas into the second outer metallic receptacle (30). Similarly, the primary closing plate (38) may be fixed by welding. Finally after drainage and addition of inert gas, a second secondary closing plate (39) that is circular in this example, will make the second metallic receptacle (30) leak tight, possibly with a leak tightness check.

Although the assembly (10) of the two metallic receptacles (20, 30) is used for storage or transport, it is also possible to condition the outer metallic receptacle (30) in a transfer package (40) with radiation shielding walls using known methods.

Leak lightness of each metallic receptacle (20, 30) can be made by any appropriate techniques, such as manual welding.

Figure 6A:
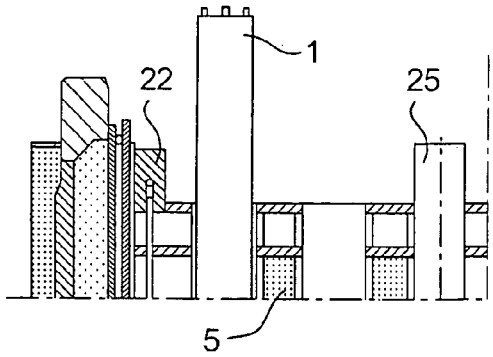
FIG. 6 shows an example block diagram of a closing system for a double leak tight metallic receptacles device.
Figure 6B:
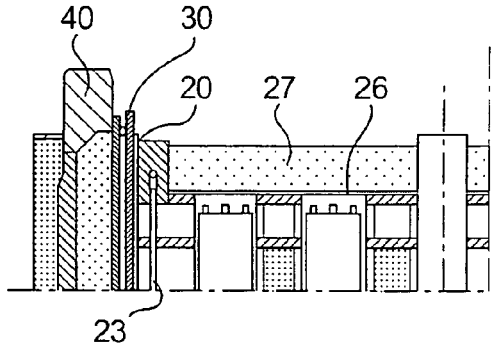
Figure 6C:
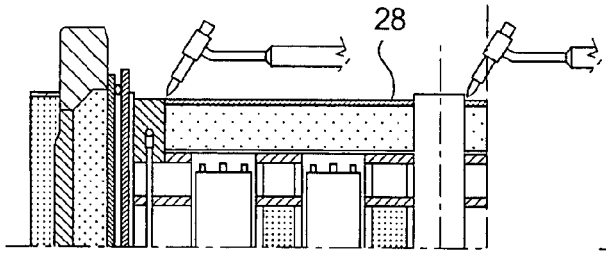
Figure 6D:
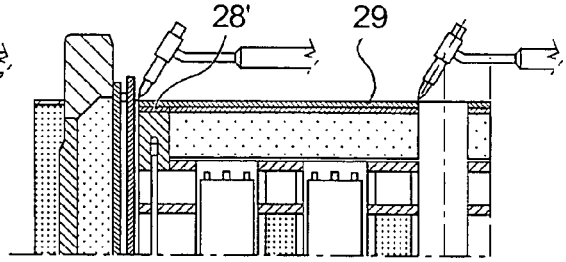
Figure 6E:
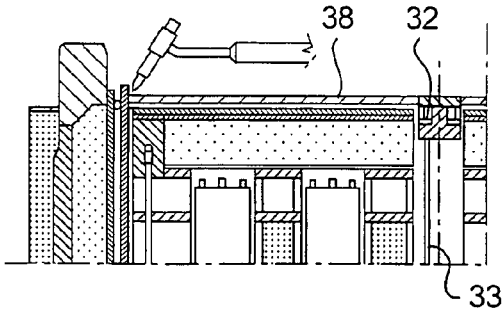
Figure 6F:
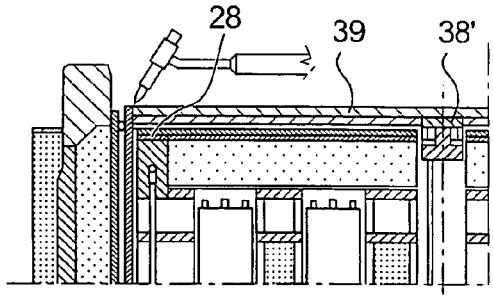

An automatic welding method is proposed to further increase safety (see FIGS. 6*a* to 6*f*), particularly suitable within the framework of the double confinement presented.

a. FIG. 6*a* shows preparation of the conditioning assembly with the inner metallic receptacle (20) inserted into the outer metallic receptacle (30), itself integrated into the transfer package (40) through a seal, in this case an inflatable seal. The nuclear fuel assemblies (1) are placed in the basket.

b. Once the metallic receptacle (20) has been filled, a shielded plug (27) is placed above a filter plate (26), and the full transfer package (40) is partially removed from the pool and placed in the "preparation, welding" area. The water level in the transfer package (40) is lowered by suction using special purpose tools, to just below the shielded plug (27).

c. The primary closing plate (28) of the inner metallic receptacle (20) is then put into place. The plate is welded on the outside onto the shell and onto the drainage device (22) and inner welding is done (on the central duct (25)); this welding is done using a previously positioned automatic welding machine.

d. As described above, inert gases are injected into the inner metallic receptacle (20) through one of the two self-closing orifices of the drainage device (22), and the secondary closing plate (29) of the inner metallic receptacle is welded on the outside (on the shell) and on the inside (on the central duct) using the previously positioned automatic welding machine.

e. The primary closing plate (38) of the outer metallic receptacle (30) is also welded, and its drainage device (32) is positioned facing the duct (25) using the previously positioned automatic welding machine, with drainage and addition of inert gas into the outer metallic receptacle (30).

f. Finally, the secondary closing plate (39) of the outer metallic receptacle is put into position before the closing weld of the closing plate is made using the previously positioned automatic welding machine.

LIST OF REFERENCE SIGNS

1 radioactive fuel assembly
2 basket for assembly
3,4 superposable baskets
5 compartment
10 conditioning device
15 device passage
20 inner leak tight receptacle
22 drainage device with orifices
23 inner receptacle dip tube
24 self-closing orifice of the drainage device
25 duct
26 upper filter plate
27 shielded plug
28 inner receptacle primary closing plate
28' inner receptacle drainage device closing plate
29 inner receptacle secondary closing plate
30 outer receptacle
32 drainage device for the outer receptacle
33 outer receptacle dip tube
34 self-closing orifice of the drainage device
35 protuberance of the outer receptacle
37 spacer pad
38 outer receptacle primary closing plate
38' outer receptacle drainage device closing plate
39 outer receptacle secondary closing plate
40 transfer package

The invention claimed is:

1. Device for conditioning of nuclear fuel assemblies comprising:

an inner leak tight metallic receptacle including a loading opening for receiving and conditioning solid nuclear fuel assemblies placed in a basket, wherein a plurality of baskets are vertically stacked within the inner leak tight metallic receptacle; and an outer leak tight receptacle that contains the inner leak tight metallic receptacle, the outer leak tight receptacle at least including a bottom and an open end, such that when the inner leak tight metallic receptacle is located in the outer receptacle, a passage remains free between the two receptacles from the open end to the bottom of the outer receptacle, said passage including means for draining water from the outer receptacle and/or for controlling the leak tightness of the outer receptacle.

2. Device according to claim 1 wherein the inner receptacle is adjusted in the outer receptacle.

3. Device according to claim 1 wherein the passage is a duct located in the inner receptacle leading to the outside.

4. Device according to claim 3, the inner receptacle and the duct of which are cylindrical-shaped with a circular cross section.

5. Device according to claim 4, the duct of which is located on the centreline of the inner receptacle.

6. Device according to claim 1 for which the inner receptacle is cylindrical-shaped and the outer receptacle comprises a protuberance delimiting said passage.

7. Device according to claim 1 comprising a shielded plug that can be fixed in a leak tight manner to the open end of the inner receptacle and such that the passage passes through the plug.

8. Device according to claim 7 comprising at least one closing plate that can be assembled such that the inner receptacle is leak tight.

9. Device according claim 1 such that the outer receptacle comprises a leak tight cover and means for draining the outer receptacle and/or controlling its leak tightness, capable of facing the passage when the inner receptacle is placed in the outer receptacle.

10. Device according to claim 1 comprising means for draining the outer receptacle including a dip tube.

11. Device according to claim 1, the outer receptacle of which is a storage package for which the sidewalls are radiation shielding.

12. Device according to claim 1 the outer receptacle of which is a leak tight metallic receptacle for conditioning of nuclear fuel assemblies.

13. Device according to claim 12 further comprising a transfer package for which the sidewalls are radiation shielding and capable of containing the outer receptacle.

14. Method of conditioning nuclear fuel assemblies under water, including placement of the assemblies into the inner leak tight metallic receptacle of the device according to claim 13, the device itself being located in the outer leak tight metallic receptacle that is itself located in the transfer package.

15. Method according to claim 14 in which a seal is used to ensure leak tightness between the outer receptacle and the transfer package.

16. Method of conditioning nuclear fuel assemblies under water, comprising placement of the assemblies into the inner leak tight metallic receptacle of the device according to claim 1, the device itself being located in the outer receptacle.

17. Method of draining an outer receptacle for radioactive material comprising:

inserting an inner leak tight metallic receptacle into the outer receptacle, the inner leak tight metallic receptacle comprising a loading opening for receiving a plurality of vertically stacked baskets, wherein each basket contains a plurality of solid nuclear fuel assemblies therein, the inner leak tight metallic receptacle and the outer receptacle having dimensions to define a passage remaining free between the two receptacles;

confining the radioactive material in the inner leak tight receptacle; and draining water from the outer receptacle through the passage.

18. Method according to claim 17 for which the outer receptacle is drained through the same end of the outer receptacle as the confinement of the inner receptacle.

19. Method according to claim 17, for which drainage is performed through a dip tube descending down to the bottom of the outer receptacle.

20. Method according to claim 17, for which the confinement of the inner leak tight metallic receptacle is performed by welding of at least one closing plate.

21. Method for double confinement of radioactive material including the drainage method according to claim 17, then confinement of the outer receptacle.

22. Method according to claim 21, wherein the outer receptacle is an outer leak tight metallic receptacle the confinement of which is performed by welding of at least one closing plate.

23. Method according to claim 22 wherein the outer receptacle is integrated to a transfer package with radiation shielding sidewalls.

24. Metallic receptacle for conditioning solid nuclear fuel assemblies, comprising a non-removable bottom and an open end, and further comprising a duct opening up in the non-removable bottom, said duct enabling drainage of water from between an adjusted receptacle, positioned within the metallic receptacle, and the metallic receptacle, wherein the adjusted receptacle contains a plurality of baskets vertically stacked within the adjusted receptacle, each basket containing one or more solid fuel assemblies therein.

* * * * *